United States Patent [19]

Volkert

[11] Patent Number: 4,833,802

[45] Date of Patent: May 30, 1989

[54] METHOD OF MAKING POP-UPS

[75] Inventor: John K. Volkert, Northfield, Ill.

[73] Assignee: One Up, Inc., Northfield, Ill.

[21] Appl. No.: 106,106

[22] Filed: Oct. 7, 1987

[51] Int. Cl.[4] ..... G09F 1/00

[52] U.S. Cl. ..... 40/124.1; 40/539

[58] Field of Search ..... 40/124.1, 530, 539, 40/538; 446/71, 147, 148, 150, 151, 152

[56] References Cited

U.S. PATENT DOCUMENTS

| | | | |
|---|---|---|---|
| 445,174 | 1/1891 | Hagelberg | 40/152.2 |
| 823,291 | 6/1906 | Quensel | 40/530 |
| 1,913,797 | 6/1933 | Dulin et al. | 446/148 |
| 2,125,268 | 8/1938 | Boyer | 40/530 |
| 2,152,299 | 12/1938 | Arndt | 40/126 |
| 2,205,262 | 6/1940 | Hayes | 40/124.1 |
| 4,103,444 | 8/1978 | Jones et al. | 40/124.1 |
| 4,146,983 | 4/1979 | Penick et al. | 40/124.1 |
| 4,313,270 | 2/1982 | Volkert et al. | 446/147 |
| 4,349,973 | 9/1982 | Penick et al. | 40/124.1 |

FOREIGN PATENT DOCUMENTS

| | | | |
|---|---|---|---|
| 851126 | 1/1940 | France | 40/539 |
| 399253 | 10/1933 | United Kingdom | 40/539 |
| 486072 | 5/1938 | United Kingdom | 434/428 |

*Primary Examiner*—Gene Mancene
*Assistant Examiner*—J. Hakomaki
*Attorney, Agent, or Firm*—Fitch, Even, Tabin & Flannery

[57] ABSTRACT

Methods for making promotional or advertising pieces containing pop-ups on a web-press by initially printing and die-cutting a continuous web of sheet material to produce an endless series of blanks, each extending transversely across the web and being arranged to create an identical piece or folder containing one or more pop-ups. A suitable adhesive pattern is applied to the web, usually closely following the die-cutting operation which cuts at least one tab and, if desired, contours one or more of the pop-up panels. Each blank contains a pair of front and rear basepieces, a pop-up panel and a tab-containing panel, either one or both of which panels includes an actuator section. Either the tab-containing panel or the tab is adhesively affixed to the undersurface of the pop-up panel, and the other is adhesively attached to the interior surface of the rear basepiece. The front basepiece swings open and carries with it the adhesively attached actuator section, pulling the pop-up panel away from the plane of the rear basepiece with its path of movement guided by the tab. Variations on the foregoing theme include the inclusion of two or more superimposed, staggered, or side-by-side pop-ups within a single promotional piece and/or the employment of a false backbone which determines the hinge line about which the front basepiece swings. A variety of particularly efficient methods of fabrication are illustrated for making such promotional pieces as a part of a web-press operation.

12 Claims, 3 Drawing Sheets

FIG 9
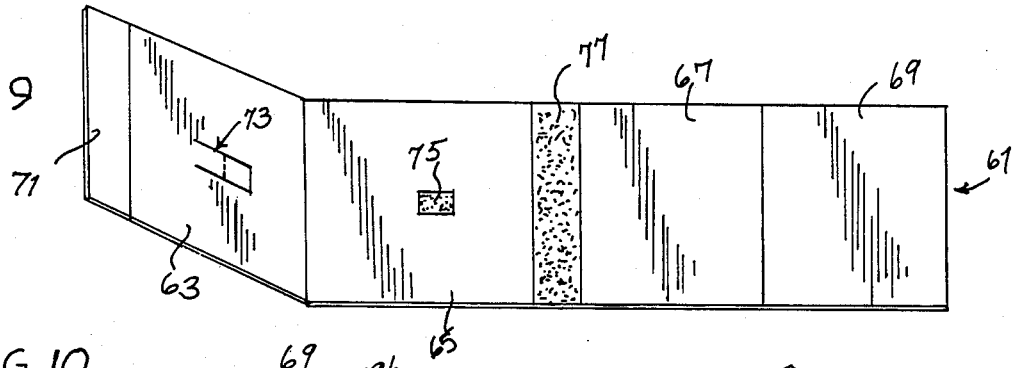
FIG 10
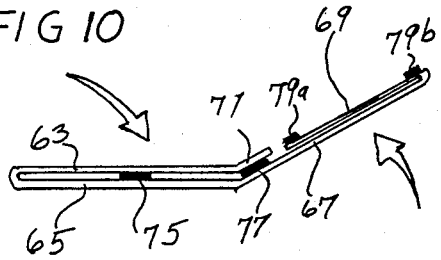
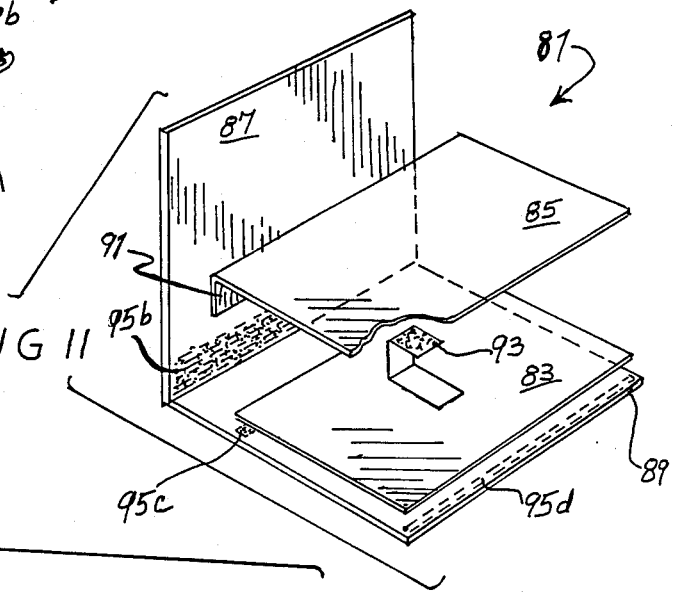
FIG 11
FIG 12
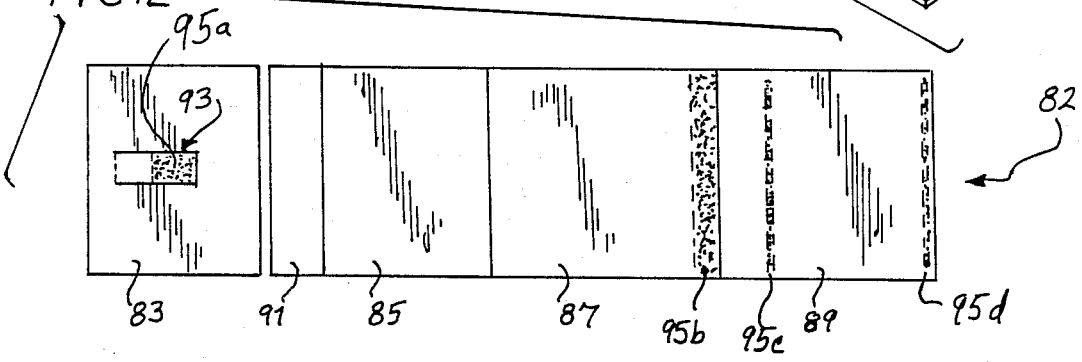
FIG 13
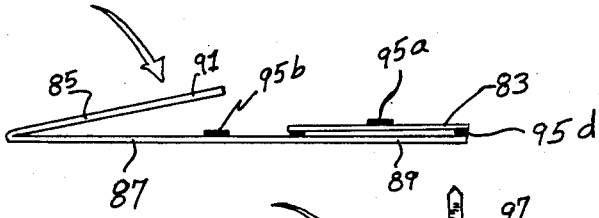
FIG 14
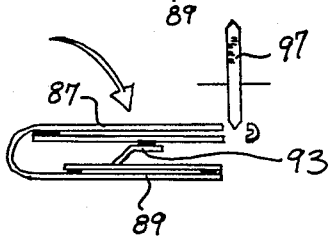

METHOD OF MAKING POP-UPS

This invention relates to printed paper novelty items of various types and, more particularly, to methods of making, on a web-press, printed pieces which contain a pop-up that moves away from the plane of the piece as it is opened.

BACKGROUND OF THE INVENTION

Pop-ups have fairly recently become frequently used in advertising and in other promotional items, whereas they had been used in the greeting card field for a number of years. Such pop-up pieces have become generally available to the advertising field as a result of the developments shown in several earlier patents, particularly U.S. Pat. No. 3,995,388, issued Dec. 7, 1976, which discloses methods for making pop-up paper products having significant advantages over hand-assembly methods that had been generally theretofore employed. U.S. Pat. No. 4,146,983, issued Apr. 3, 1979, discloses other methods for making novel promotional items, particularly those which are designed to present a plurality of coupons or the like to a recipient upon the opening of a folder. U.S. Pat. No. 4,337,589 discloses manufacturing techniques specifically suited for mass production on a web-press for making pop-up advertising pieces and the like.

Although the foregoing patents describe workable manufacturing techniques for making such advertising and promotional pieces on a web-press, development work has continued with respect to improving manufacturing methods and to providing other novel pop-up arrangements which are capable of manufacture on a web-press, thus facilitating economical mass production at prices feasible to accommodate large-scale advertising or promotional presentations.

SUMMARY OF THE INVENTION

The present invention provides attractive designs for improved promotional pop-up items of this general character which are particularly adapted for fabrication by mechanical mass production, particularly as part of a web-press operation. More particularly, the invention provides methods for printing and die-cutting a series of identical blanks as a part of a continuous web of paper being fed through a web-press, each of which blanks following completion of fabrication will produce an identical pop-up piece. By the application of adhesive to selected locations on the web and by the manipulation of the various segments of the web, such pieces having at least one pop-up are efficiently created. More specifically, a tab-containing panel is formed as a part of each blank, which achieves a suitable adhesive interconnection between a pop-up panel and one of the two basepieces which constitute the outer covers or folder of the piece. One of these two panels carries an actuator section which is adhesively connected to the other basepiece so that opening of the front basepiece causes the pop-up panel to rise up and away from the plane of the rear basepiece, to which it is attached via the tab, in an attention-attracting fashion.

BRIEF DESCRIPTION OF THE DRAWINGS

FIG. 9 is a perspective view of still another embodiment of a blank for forming a promotional piece similar to that depicted in FIG. 1.

FIG. 10 is an edge view showing further manipulation of the blank depicted in FIG. 9.

FIG. 11 is an exploded perspective view of another pop-up promotional piece embodying various features of the invention, with one element partially broken away.

FIG. 12 is a plan view of a blank for making the piece of FIG. 11.

FIGS. 13 and 14 are edge views of the blank showing it in its various states of being folded and otherwise manipulated as a part of the formation of the promotional piece of FIG. 11.

DETAILED DESCRIPTION OF THE PREFERRED EMBODIMENTS

Figure 1:
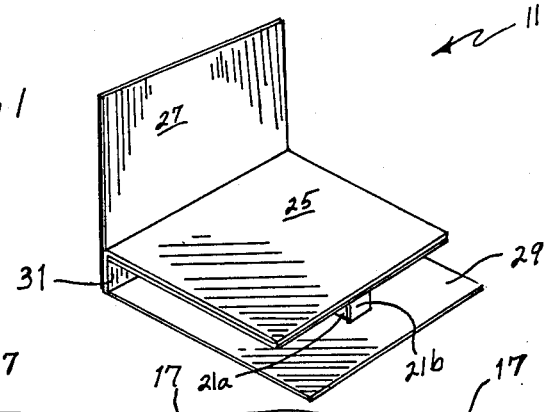
FIG. 1 is a perspective view of a pop-up promotional piece embodying various features of the invention.
Figure 2:
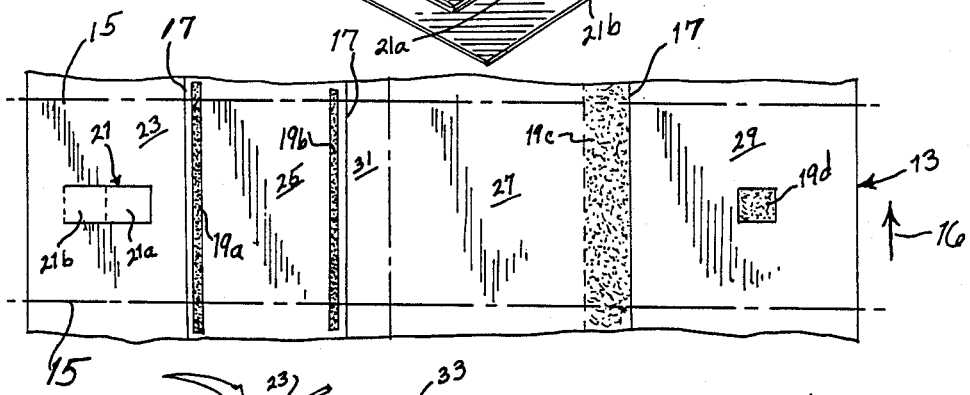
FIG. 2 is a view of the continuous web from which the piece of FIG. 1 is fashioned, showing a representative blank and the two adjacent blanks of the die-cut web that would also have been printed.

FIG. 1 shows a perspective view of a promotional piece 11 which is formed from a single printed blank 13 such as that illustrated in FIG. 2 which shows the region of a continuous web of paper or like sheet material as might be running on a web printing press. Depicted is one complete blank 13 and fragments of the preceding and following blanks in the continuous web. The blank 13 is demarcated for purposes of illustration by a pair of dot-dash lines 15 which extend transversely to the direction of movement of the web which is indicated by the arrow 16. Also shown in FIG. 2 are a plurality of solid lines 17 which indicate lines between different sections of the blank about which folding occurs; these lines may be formed as lines of weakness as by partially slitting or perforating to facilitate folding precisely at these locations. Alternatively, they may be merely printed on the blank or not demarcated at all and left to arise as a result of the actual folding manipulation of the web during the fabrication process, as these lines extend parallel to the longitudinal movement of the web. When certain of these lines are omitted, the inherent resiliency of the paper is simply relied upon to effect appropriate bending, sometimes as a result of an adjacent line of adhesive being present, particularly when a sharp line of demarcation is not considered necessary.

The same die-cutting and adhesive application steps are effected to each of the successive blanks 13 of the continuous sheet material web, which can be made of a suitable paper or paperboard material having a glossy or matte finish as desired; other sheet material, such as thin plastic, might possibly be employed. As a part of the adhesive application step or steps, an adhesive pattern 19 is applied, preferably to the upper surface of the web, as indicated in FIG. 2, which pattern is constituted by a plurality of spaced-apart strips, e.g., 19*a*, 19*b*, 19*c*, 19*d*, which may be continuous or intermittent in a longitudinal direction along the moving web. The continuous lines are applied by a line-gluer, whereas the intermittent patterns are applied by a seam-gluer. If desired, one or more of such adhesive strips or glue lines could be applied to the undersurface of the web, or one or more of them could be applied at a later stage during the fabrication process.

Although these areas are commonly referred to in the trade as glue lines, any suitable adhesive can be used in the fabrication process, including hot melt and solvent-based adhesives. Furthermore, heat-activated or an ultrasonic-activated adhesive might instead be applied either before or after die-cutting, e.g., by printing onto the continuous web; in such an instance, the adhesive character of the printed glue line may be sequentially activated, when desired, to effect a specific attachment between particular parts by subjecting one or more of such glue lines to appropriate heat or ultrasonic energy. Alternatively, a final activation step could be carried out with regard to the embodiment depicted in FIG. 2, and certain of the other embodiments illustrated hereinafter, to effect attachment at all of the glue lines. Moreover, although all of the glue lines are shown, for ease of illustration in FIG. 2, as having been applied to the web either before or shortly after the die-cutting operation and before further manipulation of the web has occurred, if desired, one or more of the glue lines could be applied at a later stage of fabrication, for example, after the web has been slit into multiple ribbons and/or after one or more folding steps has occurred.

More particularly, the fabrication process of the promotional piece 11 from the blank 13 utilizes a die-cutting operation which cuts a tab 21 from the left-hand panel 23, and one or more of the foldlines 17 may, if desired, be pressed into the paper or lightly perforated as a line of weakness. Either before, or preferably after the die-cutting step, the adhesive pattern is applied including the longitudinally extending strips or glue lines 19*a* and 19*b* (located on what is referred to as the pop-up panel 25) and a strip 19*c* plus a short glue line or spot 19*d* on two interconnected sections which are referred to as basepieces 27, 29. If desired, for example, the glue spot 19*d* could be applied at a later time to the tab 21. With reference to the finished product shown in FIG. 1, the basepiece 27 is referred to as the front basepiece, and the basepiece 29 is referred to as the rear basepiece. The pop-up panel 25 is formed with a section 31 located along its right-hand edge in FIG. 2, which is referred to as the actuator and which may optionally be defined by a longitudinally extending line of weakness 17 to facilitate precise bending at this location in the final product 11. The tab 21 is functionally broken down into a tab element 21*a* at the free end thereof and a connecting arm or extension 21*b* which is hinged to the remainder of the tab-containing panel 23. The broken lines in FIG. 2 defining the sections of the tab 21 can be formed as lines of weakness, or they may be omitted. The glue lines 19 are shown in exaggerated form in FIGS. 3 through 5 which are diagrammatic views looking at the edge of one blank as it would be seen traveling through the overall web-press operation as the manipulation steps serially occur. The exaggerated glue lines are shown in solid black so as to better stand out in the illustrations.

Figure 3:
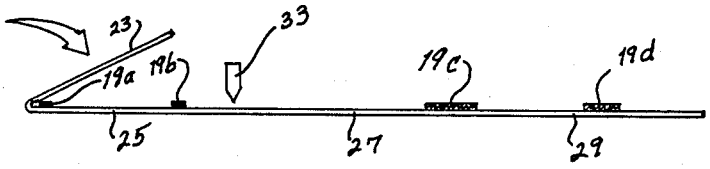
FIGS. 3, 4 and 5 are diagrammatic edge views of one blank of the continuous web showing it in its various states of being folded and otherwise manipulated as a part of the formation of the promotional piece of FIG. 1.

As depicted in FIG. 3, a folding step first occurs along the left-hand edge of web with the portion of the continuous web which constitutes the tab-containing panels 23 being folded onto the portion of the web which constitutes the pop-up panels 25. It is secured in this position by the parallel glue lines 19*a* and 19*b* which are positioned so as to be located generally along the respective lateral edges of the panel 23. Following this folding step, the overall web is severed, as by a knife diagrammatically depicted as 33 in FIG. 3, which is preferably a circular knife, to create a separate ribbon which contains the two folded panels, apart from the main web which contains the pair of basepieces 27, 29.

Figure 4:
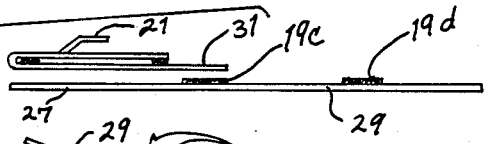

As depicted if FIG. 4, following the severing, the narrower folded ribbon is laterally displaced so as to be aligned above and along the left-hand edge of the main web and is moved downward thereonto so as to effect attachment of the undersurface of the actuator section 31 to the front basepiece 27 via the glue line 19*c*. To enable clearer understanding, the tab 21 is shown as having been pushed slightly out of the plane of the panel 23; however, it should be understood that this would not be the actual case as the tab would remain in the plane of the panel until the first time the promotional piece 11 is opened.

Figure 5:
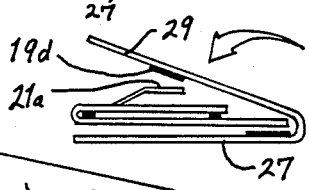
Figure 6:
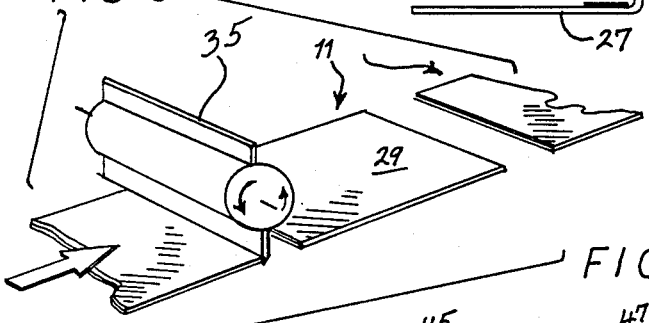
FIG. 6 is a perspective diagrammatic view showing the continuous web, following manipulation, being transversely severed to create identical individual pieces.

As finally depicted in FIG. 5, the last manipulation step folds the rear basepiece 29 over and into superimposed position upon the front basepiece 27 and the folded ribbon, sandwiching the folded ribbon between the pair of basepieces. Upon completion of the FIG. 5 folding step, the tab 21 becomes attached to the rear basepiece 29 via the glue spot 19*d* which is located on the basepiece 29 so as to precisely align with the tab element 21*a*. If desired, the completely folded web is then passed through compression rolls or the like to assure strong adhesive joinder is obtained along all of the glue lines, and thereafter, as depicted in FIG. 6, the web is severed transversely by a suitable rotary knife 35 or the equivalent to separate it into a plurality of identical, flat-folded, promotional pieces 11. Either prior to or after the transverse severing, the trimming of the left-hand edge can be carried out to provide a neat appearance, as depicted in FIG. 1, where the fold line region between the panels 25 and 23 has been removed. Although the panel 25 is shown as extending to the edge of the basepieces, it could be shortened, in which case the fold line between the panels 23 and 25 would not be trimmed.

When the promotional piece 11 is opened by pivoting the front basepiece 27 while holding the rear basepiece 29 stable, the adhesive interconnection between the interior surface of the basepiece 27 and the actuator section 15 causes the pop-up panel 25 to move away from the plane of the rear basepiece 29. The path of movement of the pop-up panel is guided by the tab 21, and the ultimate orientation generally depends upon the length of the connecting arm 21*b*. Because the tab 21 is formed from the panel 23, which is adhesively attached to the undersurface of the pop-up panel 25, the final item presents a neat, clean, unbroken appearance with the tab 21 being essentially hidden from view. Thus, this arrangement allows the creation of a pop-up panel 25 which moves to an orientation generally parallel to the rear basepiece 29 without either the pop-up panel 25 or the rear basepiece 29 being interrupted by the presence of the die-cut tab. In addition, should it be desired that the configuration of the pop-up panel 25 be other than rectangular, as depicted in FIG. 1, following the folding operation shown in FIG. 3, a die-cutting operation can be carried out so as to die-cut the folded ribbon to the desired contour. If necessary because of such contouring, the location of the tab 21 and/or the glue line 19*b* can be adjusted accordingly. Alternatively, partial die-cutting from the fold line 17 into the tab-containing panel can be carried out either in lieu of or in addition to such contouring.

Figure 7:
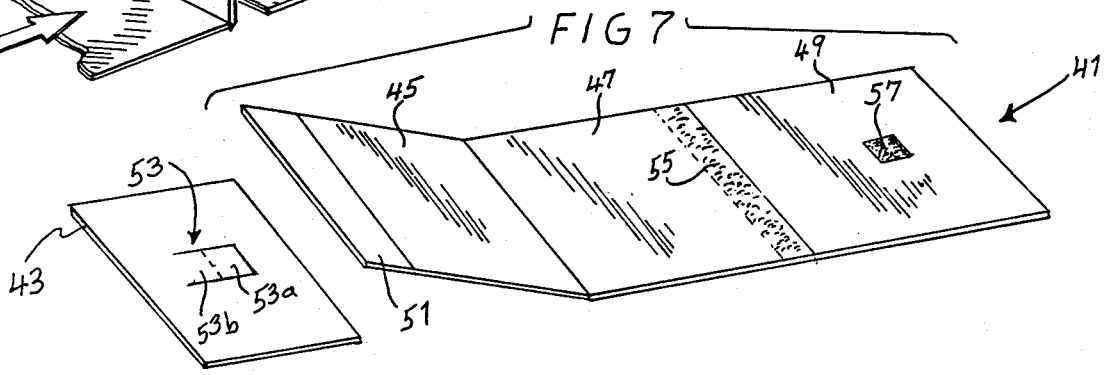
FIG. 7 is a perspective view of an alternative blank for forming a promotional piece having a pop-up substantially the same as that shown in FIG. 1.

Depicted in FIG. 7 is an alternative embodiment of a blank 41 which can be employed to create a promotional piece substantially the same as the piece 11 depicted in FIG. 1. FIG. 7 depicts the blank 41 after it has been severed to create a separate ribbon made up of only the tab-containing panels 43. In the individual blank 41, as it has been printed, die-cut and optionally pressed, scored or perforated, the pop-up panel 45 is hinged to the left-hand edge of the front basepiece 47, which is in turn formed integrally with the rear basepiece 49. An actuator section 51 is formed along the left-hand edge of the pop-up panel 45. A tab 53, similar to the tab 21, is die-cut in the panel 43 and is divided into a tab element 53*a* and a connecting arm 53*b*. As also shown in FIG. 7, a glue line 55 is applied to the front basepiece 47, and a glue spot 57 is applied to the rear basepiece 49.

Figure 8:
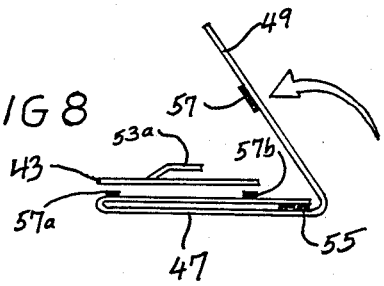
FIG. 8 is an edge view showing further manipulation of the blank depicted in FIG. 7.

Following severing, the left-hand portion of the web, as viewed in FIG. 7, is folded to place the pop-up panel 45 flush upon the front basepiece 47 and adhere the actuator section 51 thereto via the glue line 55. Following this first folding step, a pair of parallel glue lines 57*a* and 57*b*, similar to the glue lines 19*a* and 19*b*, are applied to the then upper surface of the pop-up panel 45 at the locations shown in FIG. 8. Thereafter, the ribbon consisting of the tab-containing panels 43 is moved laterally into location above the pop-panel, as shown in FIG. 8, and is then laid on top of it to effect interconnection via the parallel glue lines. Again, the tab element 53*a* is shown raised out of the plane for clarity of understanding; however, it should be understood that it would remain in the plane until the finished promotional piece were opened for the first time. Furthermore, the tab-containing panel 43 could alternatively be located adjacent the right-hand edge of the web and then be either folded onto the basepiece 49 or severed and moved laterally to the left.

Then a second folding step occurs when the rear base panel 49 is folded over the composite assembly so as to sandwich the panels 43 and 45 between the folded basepieces 47 and 49, with interconnection between the tab element 53*a* and the rear basepiece being effected by the spot of adhesive 57. As earlier indicated, the completely manipulated web would then be optionally subjected to compression and/or by trimming along the left-hand edge as seen in FIG. 8 to remove the connection between the front base panel 47 an the pop-up panel 45 at that edge. Finally, transverse severing, as shown in FIG. 6, would be effected to produce the plurality of identical promotional pieces. The final promotional piece, upon opening of the basepieces 47 and 49, would have substantially the same appearance as that shown in FIG. 1.

A further variation of the blank shown in FIG. 7 would orient the pop-up panel 45 at 180° to that depicted so that the activator section 51 lies along the right-hand edge of the pop-up panel 45; in such an instance, the panel 43 is first laterally displaced and superimposed upon the panel 45, followed by severing the panel 45 from the basepiece and laterally displacing the two interconnected panels atop the front basepiece 47.

Depicted in FIG. 9 is another alternative embodiment of a blank 61 for forming a promotional piece generally similar to that depicted in FIG. 1. The blank 61 includes a tab-containing panel 63 which is hinged to the left-hand edge of a rear basepiece 65 which lies adjacent the front basepiece 67 to the lateral edge of which is hinged the pop-up panel 69. An actuator section 71 is formed as a part of the tab-containing panel 63 in this version. The blank is initially die-cut to form the tab 73, and a glue spot 75 and a glue line 77 are applied, respectively, to the basepieces 65, 67.

As depicted in FIG. 9, a first folding operation is carried out whereby the tab-containing panel 63 and its included actuator section 71 are folded onto the rear basepiece 65, resulting in the adhesive interconnection of the basepiece 65 to the tab 73 via the adhesive spot 75. Simultaneous with the first folding, or immediately subsequent thereto, the pop-up panel 69 is folded onto the front basepiece 67 along their line of joinder. Thereafter, a pair of glue lines 79*a* and 79*b* are laid down atop the pop-up panel 69, as shown in FIG. 10. Alternatively, the glue line 77 is applied to the basepiece 67 at the same time as the lines 79*a* and 79*b* are laid down. As another alternative, the glue lines 79*a*, 79*b* can be applied to the undersurface of the web prior to the second folding step.

The final folding step is depicted in FIG. 10, showing one of the pairs of superimposed panels being folded atop the other. Shown is the folding of the front basepiece 67 onto the rear basepiece and the superimposed tab-containing panel 63; however, the panel 63 and the basepiece 65 could be folded onto the other half of the web. This final folding operation effects adhesive attachment between the pop-up panel 69 and the tab-containing panel 63 via the parallel glue lines 79*a*, 79*b* and attachment of the actuator section 71 to the front basepiece 67 via the glue line 77. Trimming is then carried out along the left-hand edge of the completely manipulated web shown in FIG. 10 to sever the connection along the two fold lines and free the pop-up panel 69 and the adhering panel 63 for independent movement away from the basepieces upon opening of the completed promotional piece, as generally illustrated in FIG. 1. The final promotional piece closely resembles that shown in FIG. 1, with the exception that the activator panel 71 is hinged to the lower tab-containing panel 63 instead of to the upper pop-up panel 69.

Yet another alternative of a promotional piece 81 is shown in exploded perspective in FIG. 11 for purposes of clear illustration. The promotional piece 81 is formed from a blank 82, shown in FIG. 12, which blank includes a tab-containing panel 83, a pop-up panel 85, and front and rear basepieces 87, 89. The actuator 91 is formed as a section of the pop-up panel 85. The tab 93 is formed as part of the initial printing and die-cutting, and the entire adhesive pattern can be initially applied to the blank. An adhesive spot **95*a* is applied to the tab 93, a wide glue line 95*b* is applied to the front basepiece, and a pair of parallel glue lines 95*c*, 95*d* are applied to the rear basepiece 89. The adhesive spot 95*a* could also be applied at a later time after severing of the panels 83**.

In the fabrication process, a ribbon constituting the tab-containing panels 83 is first severed from the remainder of the web and is displaced across the web and laid atop the rear basepiece 89 where it is affixed thereto along both edges by the parallel glue lines **95*c*, 95*d*. Alternatively, the panel 83 could be located in the blank adjacent the right-hand edge of the basepiece 89 so that, following severing, it need not be moved as far laterally. As depicted in FIG. 13, the pop-up panel 85 is then folded along its common edge with the front basepiece 87 until it lies thereatop with interconnection being established between the basepiece and the actuator section 91 via the glue line 95*b*. Thereafter, the web is folded in half, as by folding the front basepiece 87 and its interconnected pop-up panel 85 atop the rear basepiece 89, as depicted in FIG. 14, to effect adhesive interconnection between the undersurface of the pop-up panel 85 and the tab 93 via the glue spot 95*a*. Again, the tab is shown displaced slightly out of the plane of the panel 83 for clarity of understanding. Finally, following the aforementioned optional compression step, the free edge would be trimmed to eliminate the fold line between the panel 85 and the basepiece 87—as by the diagrammatically illustrated knife 97 depicted in FIG. 14**. In addition, the transverse cutting of the continuous web to produce the plurality of individual pieces is effected.

As best seen in FIG. 11 in the exploded open form, the tab-containing panel 83 is affixed to the interior surface of the rear basepiece 89. The tab 93 extends upward therefrom and is adhesively attached to the undersurface of the pop-up panel 85. Thus, the piece 81 closely resembles the piece 11, with the difference being the reversal of the location of the tab-containing panels.

Figures 15, 16, 17, 18, 19, 20, 21, 22, 23:
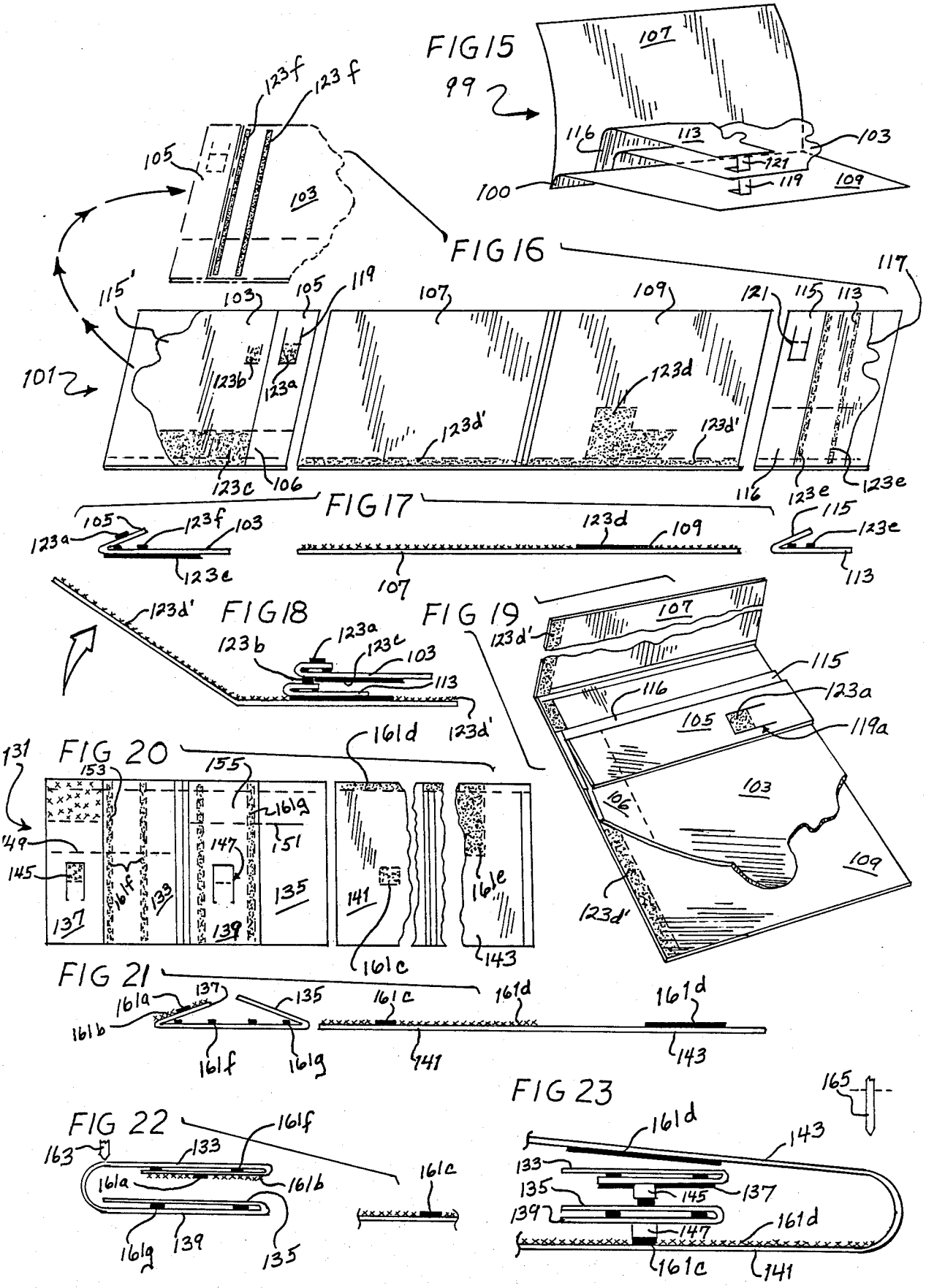
FIG. 15 is a perspective view of a further promotional piece, generally similar to that depicted in FIG. 1, which embodies other features of the invention.
FIG. 16 is a view of one blank from the continuous web from which the piece of FIG. 15 is fashioned showing the central web main and two adjacent ribbons that have been severed from the die-cut and printed web.
FIGS. 17 and 18 are edge views of the blank of FIG. 16 showing it in its various states of being folded and otherwise manipulated as a part of the formation of the promotional piece of FIG. 15.
FIG. 19 is a perspective view, with one element broken to compress it, illustrating the final folding step of the continuous web, to better show the creation of the false-backbone as seen edgewise depicted in FIG. 5.
FIG. 20 is a plan view of yet another blank for forming a promotional piece having pop-ups generally similar to those shown in FIG. 15 but which are of about equal height.
FIGS. 21, 22 and 23 are edge views showing the blank of FIG. 20 in its various states of being folded and otherwise manipulated as a part of the formation of a promotional piece having two superimposed pop-ups, with FIGS. 22 and 23 being enlarged in size.

Shown in FIG. 15 is a perspective of yet another embodiment of a promotional piece 99 which is created so as to have a false backbone 100 and which includes two partially superimposed pop-ups. FIG. 16 illustrates the blank 101 from which the piece 99 is fabricated. The blank 101 is printed so as to contain a first pop-up panel 103 which is hinged to a tab-containing panel 105, which in turn lies adjacent a rear basepiece 107 that is formed integrally with a front basepiece 109, plus a second pop-up panel 113 and its hinged tab-containing panel 115. The initial die-cutting operation creates the desired contour 115' along the lateral edge of the pop-up panel 103 and similarly cuts a desired contour 117 along the lateral edge of the pop-up panel 113 at the right-hand side of the web. In addition, the tab 119 is die-cut in the panel 105, and the tab 121 is die-cut in the panel 115. The waste at the lateral edges of the web resulting from the die-cutting of the contours 115' and 117 is removed as a part of the web-press operation by stripping from the blank following die-cutting. Transverse lines of weakness can optionally be created to define the actuator 106 which is a section of both the pop-up panel 103 and the panel 105 and define the actuator 116. The glue pattern is preferably applied to the web following a severing step.

As depicted in FIG. 16, the main web is severed adjacent the outer lateral edges of both basepieces to create a pair of ribbons, each containing one of the pop-up panels and its hinged tab-containing panel. Next, as illustrated in broken lines above the blank in FIG. 16, the left-hand ribbon is rotated 180° so as to reorient the pop-up panel 103 and its hinged panel 105. Following this manipulation of the ribbon, the glue pattern is applied. A seam-gluer applies a glue spot **123*a*, a second glue spot 123*b* and a larger glue spot 123*c* on the undersurfaces, respectively, of the tab 119 of the pop-up panel 103 and of the actuator section 106 of the pop-up panel 103 (which are illustrated on the blank before the ribbon is turned although they preferably are not applied until later). A much larger glue spot 123*d* is applied to the front basepiece 109 which extends along the trailing edge of the rear basepiece 107 and is marked 123*d'* in these regions and cross-hatched in FIGS. 17 and 18. Finally, a pair of parallel glue lines 123*e* are applied to the pop-up panel 113, and a pair of parallel glue lines 123*f* are applied to the pop-up panel 103. Next, a folding operation is carried out with each of the ribbons so that the tab-containing panel 105 is folded atop the pop-up panel 103, as shown in FIG. 17, and the tab-containing panel 115 is similarly folded atop the pop-up panel 113**. As a result of these folding steps, the tab-containing panels become adhesively attached to the respective pop-up panels via the pairs of parallel glue lines.

Next, the second pop-up panel 113, which is somewhat smaller in size than the first pop-up panel 103, can be moved into place on the front basepiece 109 and secured in this position by the adhesive attachment provided by a portion of the glue spot **123*d*. The ribbon containing pop-up panel 103 can then be displaced laterally to the right so that it is in superimposed position atop both the front basepiece 109 and the second shorter pop-up 113. It is located so that the adhesive spot 123*b* on the undersurface of the pop-up panel 103 near the lower edge thereof interconnects with the tab 121, as best seen in FIGS. 15 and 18. A further adhesive interconnection between the actuator section 106 of the pop-up 103 and the basepiece 109 and the actuator section 116 is created via the glue patterns 23*c* and 123*d*. Alternatively, the folded ribbons can first be interconnected with each other, and then the composite ribbon arrangement can be moved into place atop the basepiece 109**.

The final folding step is depicted in FIGS. 18 and 19 wherein the rear basepiece 107, carrying the glue spot **123*a*, is folded over the two pop-up panels which are superimposed upon the front basepiece 109. If the transverse glue pattern 123*d'* is not extended across the entire trailing edge of the rear basepiece 107, then a further short transverse strip of adhesive is applied to the trailing edge of the actuator section 106** prior to the final folding step so that there will be a bond in this region in the false backbone. Following the final folding step, compression can be applied to secure the adhesive bonds, as earlier discussed, particularly in the region of the trailing edge which constitutes the false backbone.

Trimming of the left-hand edge of the folded web, as viewed in FIGS. 18 and 19, is then effected to remove the original interconnection between the basepieces 107 and 109 along the fold line and thus free these two sheets at what will usually be the bottom edge of the finished promotional piece 99.

Opening of the front basepiece 107 causes it to pivot relative to the rear basepiece 109 along the false backbone 100. The adhesive interconnection of the interior surface of the front basepiece 107 with the actuator section 116 of the second or front pop-up element 113 and the actuator section 106 of the first or rear pop-up element 103 pulls the pop-up elements away from the rear basepiece 109. However, as seen in FIG. 15, the free edges of the pop-up elements are interconnected, either directly or indirectly via the tabs 119 and 121, with the front surface of the rear base panel 109 causing them to move along paths dictated by the lengths of the connecting arm portions of the tabs to superimposed orientations which are generally parallel to the plane of the rear basepiece 109. Thus, this arrangement produces an extremely attractive promotional piece wherein a true depth of field effect is created by having a shorter pop-up superimposed in front of a rear pop-up of a greater height, both of which are unbroken on their front faces by any tabs, as are the outer surfaces of the promotional piece in its closed condition, a particularly attractive arrangement which gives no hint to the presence of pop-ups within the piece, until opening.

Illustrated in FIG. 20 is a further blank for producing a promotional pop-up having two superimposed pop-up panels, generally similar to that shown in FIG. 15, which depicts an alternative arrangement of the blank. The blank 131 is laid out so that the false backbone is created along the leading edge instead of the trailing edge thereof. The blank 131 contains a first pop-up panel 133 and a second pop-up panel 135 located in the left-hand region of the continuous web, each of which panels has a tab-containing panel 137, 139, respectively, hinged to the left-hand lateral edge thereof. The pair of basepieces 141, 143 constitute the right-hand portion of the continuous web. The web is initially die-cut to create tabs 145, 147 in the appropriate panels, and, if desired, a pair of transverse lines of demarcation 149, 151, such as light perforations, can be cut into the respective panels to more specifically define the regions which will serve as the actuator sections 153 and 155.

A ribbon is then severed from the left-hand portion of the web containing both the pop-up and tab-containing panels. Glue spots **161*a* and 161*b* are respectively applied to the undersurfaces of the tab 145 and the top edge of the panel 137 in the region of the false backbone and the actuator section. Spots of glue 161*c* and 161*d* are applied to the basepiece 141, and a glue spot 161*e* is applied to the front basepiece 143, as shown in FIG. 20. Two pairs of parallel glue lines 161*f* and 161*g* are preferably applied to the first pop-up panel 133 and to the tab-containing panel 139, as illustrated in FIGS. 20 and 21. Then, both lateral edges of this ribbon are folded inward, as depicted in FIG. 21. As a result of this dual folding step, the parallel lines of adhesive 161*f* affix the tab-containing panel 137 and its associated portion of the actuator 153 atop the pop-up panel 133 and its actuator section, and the pop-up panel 135 and its actuator section 155 are affixed atop the tab-containing panel 139 and its section of the actuator by the parallel glue lines 161*g***.

Next, the ribbon is folded in half, as depicted in FIG. 22, with the pop-up panel 133 and its affixed tab-containing panel 137 being folded over the other two panels. This folding step bonds the tab 145 to the pop-up panel 135 via the glue spot **161*a* and establishes an interconnection in the region of the false backbone and the actuator section 155 via the glue pattern 161*b*. If desired, compression can be applied to the finally folded ribbon so as to secure the adhesive interconnections prior to the trimming of the left-hand edge by a circular knife 163 to remove the original fold line interconnection between the panels 133 and 139**.

Following trimming, the composite folded ribbon is displaced laterally to the right and laid into position atop the basepiece 141 where it becomes secured by the line of adhesive **161*e* in the region of the false backbone. This transverse adhesive region is preferably applied just prior to the application of the parallel lines of adhesive 161*f* and 161*g* but could, if desired, be applied at a later time during the fabrication process. As illustrated diagrammatically in the enlarged fragmentary view 23, as a result of this displacement step, the tab 147 becomes attached to the rear basepiece 141 via the glue spot 161*c* at the same time as the bond is created in the region of the false backbone as a result of the transverse glue line 161*d*, which is shown by cross-hatching in FIGS. 21 and 23. Again, for ease of understanding, the tab 147 is shown extended from the plane of the panel 139 although, as earlier explained, the tab would remain within the plane of the panel until the first opening of the completed promotional piece. The tab 145 is similarly shown extending out of the plane of the panel 137**.

The final folding step takes place by the folding of the right-hand portion of the web constituting the front basepiece 143 over the remainder of the web, as depicted in FIG. 23. As a result of this folding, the glue pattern **161*e* interconnects the interior surface of the front basepiece 143 with the actuator section 153 of the first or front pop-up, which is in turn adhesively interconnected with the actuator section 155 of the second or rear pop-up via the adhesive spot 161*b*. Following this folding step, a compression step is optionally applied which assures that a good adhesive interconnection is effected throughout the overall arrangement, particularly in the region along the transverse line 161*b* which interconnects the actuator sections and establishes the false backbone. A trimming operation is then effected to remove the right-hand edge of the folded web, as depicted by the circular knife 165 in FIG. 23, which trimming eliminates the original interconnection between the two basepieces 141, 143** along the fold line. The left-hand edge of the web can also be trimmed for neatness, and the web is cut transversely to provide the plurality of identical promotional pieces.

Upon opening of one of the promotional pieces, an effect generally similar to that shown in FIG. 15 is created. Namely, swinging of the front basepiece 143 about the hinge line provided with the rear basepiece 141 by the false backbone, pulls the actuator section 153 of the front pop-up with it, which in turn pulls the actuator section 155 of the rear pop-up, causing both pop-ups to move away from the plane of the rear basepiece 141. Again, the path of movement is defined by the tabs 145, 147 which are directly or indirectly connected to the rear basepiece 141. Thus, the arrangement of the blank 131 shown in FIG. 20 provides a particularly efficient way of creating a promotional piece having a pair of superimposed pop-ups having unbroken front faces that create an attractive display.

Although the invention has been described with respect to a number of preferred embodiments incorporating various features of the invention, it should be understood that changes and modifications to the embodiments shown, as would be obvious to one having the ordinary skill in the art, may be made without deviating from the scope of the invention which is set forth in the claims appended hereto. For example, should it be desired to contour the pop-ups 135 and 137 illustrated in FIGS. 20–23, the folded ribbon depicted in FIG. 21 can be die-cut along one or both of the edges to provide such contours by removing the desired lateral edge portions, which will then provide contours that will constitute the upper edges of the pop-ups in the ultimate promotional piece. Instead of contouring one of the pop-ups 135, 133 by simultaneously die-cutting the folded ribbon, a partial die-cut could earlier be provided in one or both of the tab-containing panels 137–139 which would extend outward from the fold line at the common edge and thus provide an extension of the pop-up panel using material removed from the hidden rear surface of the tab-containing panel, resulting in an attractive overall effect without additional paper.

If necessary, the placement of the parallel lines of adhesive 161*a* and 161*b* can be adjusted so as to accommodate such contouring. Likewise, it should be understood that, if superimposed pop-ups are not desired, the pop-up elements, as, for example, those shown in the FIG. 15 version, can be proportioned accordingly and placed side-by-side on the basepiece 109 to create such an arrangement. Moreover if, for example, with such a side-by-side arrangement, it should be desired that one of the pop-ups should be attached by a tab to the rear basepiece (as in the embodiments now shown) but the other pop-up is to be attached by a tab to the front basepiece, then one of the folded ribbons depicted in FIG. 17 can be turned over, or rotated 180°, prior to being laid down upon the basepiece 109 in such a side-by-side arrangement and the glue patterns can be adjusted appropriately, so that one of the pop-ups will be connected by a tab to each of the basepieces and the respective actuator sections will be adhesively attached to the other basepiece. Likewise, the invention is not limited to the creation of two pop-ups in a single promotional piece, but three or more pop-up panels could be included by duplicating what is shown. With such an arrangement, or even with the incorporation of two pop-up panels, it might be desired to stagger the placement of the pop-ups slightly so there is only partial superimposition of one atop another.

Particular features of the invention are emphasized in the claims that follow.

What is claimed is:

1. A method of making pieces containing pop-ups from a continuous web printed on a web press, which method comprises:

printing a continuous web of sheet material to produce a series of interconnected blanks each extending transversely of said continuous web, said blanks each including a pair of basepieces, an uninterrupted pop-up panel and tab-containing panel distinct from said pop-up panel and from said basepieces, one of which panels has an attached actuator section, moving said continuous web through a series of steps including the step of die-cutting a tab within said tab-containing panel, applying adhesive to selected locations on said moving web, manipulating said pop-up panel and said tab-containing panel to cause them to move relative to each other and to said basepieces and manipulating at least one of said basepieces so that said actuator section becomes adhesively attached to one of said basepieces, so that either said tab-containing panel or said tab becomes adhesively joined to the undersurface of said pop-up panel, so that the other of said tab-containing panel and said tab becomes adhesively joined to the other of said basepieces without handling said tab itself, and so that said pop-up panel and said tab-containing panel become sandwiched between said basepieces which are hingedly interconnected near one edge while said basepieces, said pop-up panels and said tab-containing panels each remain continuous parts of said web, and cutting said web transversely of the series of manipulated blanks to create a plurality of structurally identical flat individual pieces each containing an uninterrupted pop-up that moves away from the respective planes of both basepieces when said basepieces are opened by pivoting along the hinge therebetween with the path of said movement being defined by said tab.

2. A method according to claim 1 wherein said tab-containing panel is adhesively joined to the undersurface of said pop-up panel, and said tab is adhesively joined to said other basepiece.

3. A method according to claim 1 wherein said actuator section is integral with said pop-up panel in said blank and is hinged thereto along a line of weakness.

4. A method according to claim 1 wherein said web is printed and die-cut so that, in each of said blanks, said basepieces are joined along a common lateral edge which forms said hinge.

5. A method according to claim 4 wherein said pop-up panel, said actuator section and said tab-containing panel are located adjacent a first lateral edge of one of said basepieces in said blank, and wherein said manipulating step folds said blank along a common lateral edge between said pop-up panel and said tab-containing panel to superimpose one upon the other and effect adhesive interconnection therebetween.

6. A method according to claim 5 wherein said manipulating step subsequently folds said superimposed panels about said first lateral edge onto said adjacent basepiece.

7. A method according to claim 1 wherein said adhesive application is such that a false backbone is created along a straight line which constitutes either the leading edge or the trailing edge of each blank of said continuous web.

8. A method according to claim 7 wherein said pair of basepieces is located centrally within each blank and adjacent each lateral edge thereof is a combination of a tab-containing panel and a pop-up panel, and wherein said manipulating step folds each tab-containing panel onto the associated panel to adhesively interconnects them and thereafter locates one of said combinations upon one of said basepieces and the other combination between said one combination and said other basepiece so that the tab of one of said combinations is adhesively attached to the pop-up panel of the other of said combinations.

9. A method according to claim 8 wherein said pop-up panels are located along each lateral edge of said blank and wherein said die-cutting step forms a decorative irregular edge in each pop-up panel and removes the scrap portions created along both edges of the blank.

10. A promotional piece containing a pop-up which is designed for fabrication on a web press, which piece comprises:

printed and die-cut sheet material which includes first and second basepieces, a first uninterrupted printed pop-up panel and a first tab-containing panel which is distinct from said pop-up panel and from said basepieces, one of which panels has an attached actuator section, said actuator section being adhesively attached to said first basepiece, one of said tab-containing panel and said tab being adhesively joined to the undersurface of said pop-up panel, and the other of said tab-containing panel and said tab being adhesively joined to said second basepiece, said pop-up panel and said tab-containing panel being sandwiched between said basepieces, and said basepieces being hingedly interconnected near one edge, whereby when said basepieces are opened by pivoting along the hinge, said actuator causes said uninterrupted pop-up panel to move away from the respective planes of both basepieces, its path of movement being determined by the effective length of said tab which is hidden from view by said uninterrupted pop-up panel.

11. A promotional piece according to claim 10 wherein a line of adhesive creates a false backbone along a straight line which constitutes the hinge between said basepieces, said actuator section being adhesively joined to said first basepiece at a location adjacent said straight line.

12. A promotional piece according to claim 11 wherein said tab is adhesively joined to said second basepiece, wherein a second pop-up panel, a second tab-containing panel and a second actuator section are included, and wherein said actuator section is adhesively joined to said first basepiece at a location further from said straight line that said first actuator section and said second tab is adhesively joined to said first pop-up panel.

* * * * *